US011400507B2

(12) United States Patent
Reininger et al.

(10) Patent No.: US 11,400,507 B2
(45) Date of Patent: Aug. 2, 2022

(54) METHOD FOR INCREASING THE PLASTIC DEFORMABILITY OF A WORKPIECE USING AN ABSORPTION AGENT

(71) Applicant: COSMA ENGINEERING EUROPE GMBH, Weikersdorf (AT)

(72) Inventors: Thomas Reininger, Weigelsdorf (AT); Andreas Stranz, Reichenau (AT); Christian Juricek, Vienna (AT)

(73) Assignee: Cosma Engineering Europe GmbH, Weikersdorf (AT)

( * ) Notice: Subject to any disclaimer, the term of this patent is extended or adjusted under 35 U.S.C. 154(b) by 53 days.

(21) Appl. No.: 16/095,425

(22) PCT Filed: Apr. 21, 2017

(86) PCT No.: PCT/EP2017/059517
§ 371 (c)(1),
(2) Date: Oct. 22, 2018

(87) PCT Pub. No.: WO2017/182629
PCT Pub. Date: Oct. 26, 2017

(65) Prior Publication Data

US 2019/0134692 A1 May 9, 2019

(30) Foreign Application Priority Data

Apr. 22, 2016 (DE) ..... 10 2016 206 899.7

(51) Int. Cl.
*C21D 1/34* (2006.01)
*C21D 1/68* (2006.01)
(Continued)

(52) U.S. Cl.
CPC ..... *B21D 37/16* (2013.01); *C21D 1/34* (2013.01); *C21D 1/68* (2013.01); *C22F 1/00* (2013.01);
(Continued)

(58) Field of Classification Search
None
See application file for complete search history.

(56) References Cited

U.S. PATENT DOCUMENTS 3,475,639 A * 10/1969 Lebel ..... H01J 29/32 313/106
3,556,255 A * 1/1971 Lomax, Jr. ..... B21J 3/00 184/109
(Continued)

FOREIGN PATENT DOCUMENTS

CN 102764724 A 11/2012
CN 107530725 A 1/2018
(Continued)

OTHER PUBLICATIONS

English translation of DE 10162415-A (originally published Jul. 3, 2003) from Espacenet.*
(Continued)

*Primary Examiner* — George Wyszomierski
(74) *Attorney, Agent, or Firm* — Dickinson Wright PLLC

(57) ABSTRACT

A method for at least locally increasing the plasticity of a metal workpiece, which contains in particular an aluminum alloy, wherein the workpiece is irradiated in order to increase its temperature, and an associated production device, is provided. In order to be able to more quickly and thoroughly heat specific regions of a metal workpiece than other regions in a targeted manner, wherein it is possible to heat these regions more quickly and thoroughly with the same radiation output, while the surface of the workpiece remains largely unaffected, it is proposed that an absorbent be applied at least locally to the workpiece prior to irradiation thereof, wherein the degree of absorption of the absorbent for the radiation is greater than the degree of absorption of the workpiece for the radiation.

14 Claims, 5 Drawing Sheets

(51) Int. Cl.

| | |
|---|---|
| ***B21D 37/16*** | (2006.01) |
| ***C22F 1/04*** | (2006.01) |
| ***C22F 1/00*** | (2006.01) |
| ***F27D 11/12*** | (2006.01) |
| *F27D 99/00* | (2010.01) |

(52) U.S. Cl.
CPC ..... *C22F 1/04* (2013.01); *F27D 11/12* (2013.01); *C21D 2221/00* (2013.01); *F27D 2099/0028* (2013.01)

(56) References Cited

U.S. PATENT DOCUMENTS

| | | | | | |
|---|---|---|---|---|---|
| 3,983,889 | A * | 10/1976 | Thym | C23G 3/023 | 134/9 |
| 4,090,889 | A * | 5/1978 | George | C22F 1/047 | 148/516 |
| 4,504,527 | A | 3/1985 | Hara et al. | | |
| 4,623,820 | A * | 11/1986 | Deal | H01J 29/28 | 313/466 |
| 8,211,251 | B2 | 7/2012 | Carsley et al. | | |
| 2010/0296253 | A1 * | 11/2010 | Miyamoto | C23C 4/01 | 361/705 |
| 2011/0036472 | A1 | 2/2011 | Carsley et al. | | |
| 2014/0048181 | A1 * | 2/2014 | Banik | C23C 2/06 | 148/230 |
| 2014/0335368 | A1 * | 11/2014 | Faruque | B21D 47/04 | 428/594 |
| 2018/0056388 | A1 | 3/2018 | Sksek et al. | | |

FOREIGN PATENT DOCUMENTS

| | | | | |
|---|---|---|---|---|
| DE | 10162415 | A1 | | 7/2003 |
| EP | 0992300 | A2 | | 4/2000 |
| EP | 0996760 | A1 | | 5/2000 |
| JP | 59179265 | A | * | 10/1984 |
| JP | H0949043 | A | | 2/1997 |
| JP | 2001259554 | A | * | 9/2001 |
| JP | 3256108 | B2 | | 2/2002 |

OTHER PUBLICATIONS

English Translation of JP 59-179265 (originally published Oct. 11, 1984) from J-Plat Pat.*

English Translation of JP 2001-259554 (originally published Sep. 25, 2001) from Espacenet.*

* cited by examiner

METHOD FOR INCREASING THE PLASTIC DEFORMABILITY OF A WORKPIECE USING AN ABSORPTION AGENT

CROSS REFERENCE TO RELATED APPLICATIONS

This U.S. National Stage Patent Application claims the benefit of PCT International Patent Application Serial No. PCT/EP2017/059517 filed Apr. 21, 2017 which claims the benefit of and priority to DE Patent Application Ser. No. 10 2016 206 899.7 filed on Apr. 22, 2016, the entire disclosures of the applications being considered part of the disclosure of this application, and hereby incorporated by reference.

BACKGROUND OF THE INVENTION

1. Field of the Invention

The invention relates to a method for at least locally increasing plasticity of a metal workpiece, and an associated device and a corresponding use of a mixture applied to a metal workpiece.

1. Related Art

Methods are known in the field for the family specified above, in which a metal workpiece, e.g. an aluminum plate, is thoroughly heated in an oven through the radiation absorbed by the surface of the workpiece, wherein the plasticity of the workpiece is increased. The portion of radiation absorbed by the surface of the workpiece depends thereby on the degree of absorption of the material of the workpiece. Furthermore, the workpiece is heated uniformly. With aluminum alloys, in particular those containing copper and magnesium alloy elements, a structural change takes place at high temperatures, increasing the solubility of the alloy elements in crystal lattices of the aluminum, thus resulting in an increase in the plasticity of the workpiece.

Particularly when only specific areas of the workpiece are to be shaped in a shaping process following the heating, is may be advantageous to primarily heat specific areas of the workpiece, such that a more favorable relationship between the heating time, radiation output and reachable temperature is obtained. The contact of the surface of the workpiece with a heating element used for this may lead to unfavorable effects on its surface, e.g. degradation of the aesthetic appearance.

EP 0996760 B1 proposes a method for improving plasticity of aluminum plates in which an area of the plate that is to be bent is heated. The heating takes place by means of an inductive heating coil, the outer shape and size of which is adapted to an area of the plate that is to be heated. Immersion baths, laser heating or contact heating with a heated plate are specified as alternatives to an induction coil, but without detailed instructions for any of the alternative heating methods. The proposed heating processes can be adapted individually to the respective geometry of the workpiece and the respective region of the workpiece that is to be heated. The energy absorbed by the workpiece for heating it is substantially dependent on the material that is to be heated.

EP 0 992300 B1 discloses a shaping method for precipitation-hardened aluminum alloys, wherein specific regions of an aluminum plate that is to be shaped are heated in a targeted manner, in order to increase the plasticity thereof, and to prevent material failure during the shaping process.

Specific measures for generating or influencing the change in temperature in regions of the aluminum plate are not discussed therein.

SUMMARY OF THE INVENTION

The fundamental object of the invention is to improve a method from the family of methods specified in the introduction, in that specific regions of a metal workpiece can be heated in a targeted manner to a greater extent, and more quickly than other regions, wherein the same radiation output should result in a quicker and greater heating, while affecting the surface of the workpiece as little as possible. Furthermore, an associated device is also proposed.

The problem addressed by the invention is solved by a method that at least locally increases the plasticity of a metal workpiece, which contains an aluminum alloy, wherein the workpiece is irradiated in order to increase its temperature, an absorbent is applied at least locally to the workpiece prior to irradiation, and the degree of absorption of the absorbent for the radiation is greater than the degree of absorption of the workpiece for the radiation.

Because of the higher degree of absorption of the absorbent, a greater portion of the radiation is absorbed by the absorbent than by the surface of the workpiece to which the absorbent has been applied. As a result, the absorbent heats up more quickly. The comparatively strongly heating absorbent conducts the absorbed heat to the underlying surface of the workpiece covered by the absorbent, such that the regions of the workpiece covered by the absorbent heat up significantly more quickly than any of the regions of the workpiece not covered by an absorbent. As a result, a higher temperature can be reached with radiation over the same time period and with the same irradiation rate. Accordingly, a given temperature can be reached with the same irradiation rate in less time. Less time is needed to reach the same end temperature with the same radiation output.

Through targeted, stronger heating of individual regions of the workpiece, this can be adapted flexibly to subsequent method steps, particularly for shaping the workpiece, such that when the plasticity of the workpiece is dependent on the prior heating temperature, different regions of the workpiece may exhibit different plasticities.

Advantageously, the absorbent can adhere to the workpiece where it is applied during the irradiation thereof. As a result, it is possible to more precisely position the absorbent and consequentially, precisely define the comparatively more strongly heated regions of the workpiece. The regions that are to be heated more can be readily delimited from the other regions. The absorbent can remain relatively consistently in its original position, even when the workpiece is shaken or moved.

In particular, the absorbent can be applied to at least two sides of the metal workpiece. As a result, the radiation absorption of the workpiece can be further improved, to ensure a quick and effective heating of the workpiece. Targeted regions of the workpiece can thus be more effectively heated from two sides of the workpiece.

According to one variation, the absorbent can contain grey and/or black components. As a result, the absorbent may have a high degree of absorption, in particular for visible light, as well as heat and infrared radiation, ensuring a good absorption of a large portion of the heating radiation.

The absorbent may contain graphite. Graphite is an inexpensive and readily obtainable substance, which exhibits a good degree of absorption, particularly for visible light and infrared radiation, due to its color.

In one embodiment, the absorbent can partially evaporate after application to the workpiece, in particular prior to irradiation. This results in a division of responsibilities between the evaporating components of the absorbent and those components remaining on the workpiece after evaporation. By way of example, the evaporating components may improve the fluidity and workability of the absorbent, while the remaining, i.e. non-evaporating, components adhere well to the workpiece, for example, or exhibit a favorable degree of absorption.

The absorbent can conceivably contain at least one liquid carrier medium and/or at least one solid, in particular powdered, absorbent. As a result, the different requirements for the absorbent can be favorably divided, e.g. flowability, fluidity, applicability, degree of absorption, and adhesion. By way of example, the carrier medium can be readily applied and worked, while the absorbent has a good degree of absorption, and can adhere to the workpiece particularly well.

The absorbent can be sprayed onto the workpiece in a special way, in particular by means of a nozzle. As a result, the absorbent can be applied evenly and comparatively thoroughly to the workpiece. A nozzle is a convenient and practical means of spraying an absorbent onto a workpiece.

According to one variation, the absorbent can be applied to the workpiece by means of at least one applicator roller. As a result, the absorbent can be applied in a targeted manner to the region of the workpiece that is to be coated.

In a further development, after the radiation has been applied to the workpiece, a cleaning agent, containing liquid and/or gaseous components in particular, can be applied to the workpiece, wherein the absorbent is at least partially removed from the workpiece. After removal of the absorbent, the workpiece can be prepared or used for further production steps, wherein the absorbent removed from the workpiece has no, or only a slight, effect on these subsequent production steps. A greater portion of the absorbent can be removed through the use of the cleaning agent. In particular, a portion of the absorbent can be soluble in the liquid or gaseous components, such that it can be conveniently removed from the surface of the workpiece.

The cleaning agent can be sprayed in a special manner under pressure onto the workpiece, wherein the workpiece can be cleaned in particular by blasting it with a jet spray thereof. The cleaning agent can exert additional forces on the surface of the workpiece and the absorbent thereon through the pressure, in order to better release the absorbent from the workpiece, and largely remove it. The jet spray cleaning principle is a particularly efficient means of removing the absorbent form the surface of the workpiece.

In an alternative embodiment, the absorbent can be stripped, at least partially, by means of a scraper, in particular a stripping roller, after the workpiece has been subjected to the radiation. The absorbent can largely be removed through the mechanical stripping, and remains substantially pure thereby, such that it can be reused. The use of stripping rollers keeps the friction between the surfaces of the workpiece to a minimum, in order to have as little effect as possible on the surface of the workpiece during the stripping.

The objective of the invention is also achieved through a device for locally increasing the plasticity of a metal workpiece, which has an irradiation station in which a metal workpiece can placed during the course of production, which can then be irradiated in order to heat it, and wherein a coating station is upstream of the irradiation station with which an absorbent can be applied to the metal workpiece at least locally.

By providing an irradiation station in the production process, the plasticity of a workpiece can be increased by subjecting the metal workpiece to radiation. As a result, increasing the plasticity through local heating of the workpiece can be improved with regard to the necessary radiation output, the irradiation time required, and the temperature that can be reached.

In one embodiment, the coating station can have at least one nozzle designed for spraying the absorbent onto a metal workpiece. As a result, the absorbent can be evenly and thoroughly applied to the workpiece.

The coating station can advantageously include at least one applicator roller, to which the absorbent adheres, and which can be designed for applying the absorbent to a metal workpiece. As a result, the absorbent can be applied to a specific location, and with the desired thickness, on the workpiece.

According to a further variation, a cleaning station can be provided downstream of the irradiation station in the production process, which is designed to at least partially remove an absorbent from a metal workpiece. As a result, the absorbent can be removed from the workpiece in order to prepare the workpiece for subsequent production steps.

In accordance with a further development, the cleaning station can include at least one stripper, in particular at least one stripping roller. The absorbent can be efficiently stripped from the surface of the metal workpiece by means of the stripper, in order to clean the metal workpiece, and to potentially recover the absorbent after irradiating the workpiece. A stripping roller can be rolled in particular over the workpiece, thus keeping the resulting friction and effects on the properties of the surface of the workpiece to a minimum.

It is also conceivable for the cleaning station to have a cleaning nozzle designed to spray a cleaning agent onto the metal workpiece under pressure, and to clean the workpiece, in particular by means of a jet spray. As a result, the absorbent can largely be removed relatively simply and reliably from the metal workpiece. In particular with three dimensional and complex shapes, a cleaning nozzle allows for a thorough removal of an absorbent.

The object of the invention specified above is likewise achieved by the use of a mixture comprising at least one liquid carrier medium, and on radiation absorbing solid and powdered absorbent for at least local application to a metal workpiece and increased transfer of an absorbed radiation energy into the metal workpiece.

The mixture that is used can act as an absorbent, and can absorb a higher portion of radiation applied thereto than the surface of the metal workpiece, such that the mixture is heated more than the surrounding, uncoated surface of the workpiece, and discharges the absorbed energy in the form of heat, at least locally, onto the workpiece. This enables a targeted heating of specific regions of the metal workpiece, or a greater heating than other regions of the metal workpiece in a targeted manner. A higher end temperature of the workpiece can be obtained through the intensified absorption with the same irradiation time and the same radiation output, at least locally. The same end temperature requires shorter irradiation times at the same radiation output; analogously, for the same target temperature and irradiation time, a lower irradiation rate is required. By using a solid or powdered absorbent and a liquid carrier medium in particular, the mixture can be adapted well to its objective and associated subsidiary objectives. The carrier medium, for example, can thus be particularly efficiently applicable and workable, while the absorbent can exhibit a particularly high degree of absorption or advantageous adhesive properties to the workpiece.

According to a further development, the absorbent can include grey and/or black components. As a result, the degree of absorption of the absorbent, in particular for visible light as well as heat and infrared radiation, can be advantageously particularly high.

In an alternative embodiment, the absorbent can include graphite. Graphite is an economical and conveniently available substance, which exhibits a high degree of absorption for radiation, in particular visible light, as well as heat and infrared radiation.

The carrier medium may be able to at least partially evaporate into the atmosphere. As a result, the portion of the carrier medium in the absorbent can be efficiently reduced on the surface of the workpiece after application of the absorbent. Specifically, with a functional separation of the components of the absorbent, in which the degree of absorption is primarily determined by a solid or powdered absorbent, and the carrier medium primarily contributes to an efficient application, the effects of the carrier medium on the radiation absorption can thus be reduced, and the positioning and retention of the position of the absorbent on the surface of the workpiece can be improved.

In accordance with a further development, the carrier medium can contain at least one hydrocarbon. As a result, the absorbent can be readily applied and worked, or the carrier medium can be efficiently evaporated, for example.

The invention shall be explained below based on exemplary embodiments.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENT

Identical reference symbols shall be used for identical or corresponding features of the invention in the various figures.

Figure 1:
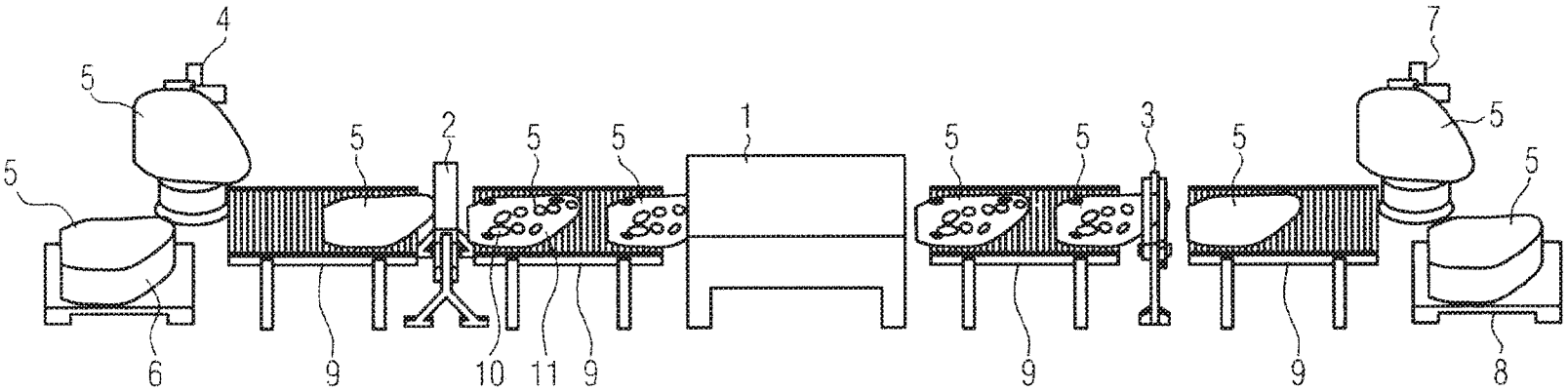
FIG. 1 shows a schematic illustration of a first exemplary embodiment of a production device according to the invention.

FIG. 1 shows a production device according to the invention, which has an irradiation station in the form of an infrared oven 1, and a coating station 2, by means of which an absorbent can be applied to metal workpieces 5. Instead of an infrared oven, other ovens can also be used.

The metal workpieces are thin, flat plates made of an aluminum alloy that can be hardened through precipitation in the exemplary embodiment shown therein. The use of workpieces of a different shape, e.g. having a round or polygonal shape, or more massive workpieces, is also conceivable. Furthermore, the production device has a cleaning station 3, by means of which an absorbent can be removed from metal workpieces. The production device also has an infeed station 4, in which individual workpieces are removed from a first stack 6 and supplied to the production device, and a stacking station 7, in which individual workpieces are stacked on a second stack 8 after passing through the production device.

Conveyors in the form of conveyor rollers 9 are located between and/or in the individual stations, which convey the individual workpieces 5 from one station to the next, and convey the workpieces through the stations. The conveyance of the workpieces from one station to the next can alternatively be achieved with grippers, e.g. robot grippers, or manually. The conveyor rollers 9 can be disk rollers. In particular when the surface of the workpiece 5 that comes in contact with the rollers is also coated with an absorbent 10, the disk rollers are suitable for maintaining the positioning of the absorbent intact during the conveyance.

Before passing through the coating station 2, there is no surface coating on the workpieces 5 that would affect the degree of absorption. After passing through the coating station 2, while passing through the infrared oven 1, and prior to passing through the cleaning station 3, the locally applied absorbent 10 is located on a limited area of the workpieces 5. Where no absorbent 10 has been applied to the surface of the workpiece 5, there are regions 11 of the workpiece that have no absorbent 10. Alternatively, it is likewise conceivable to coat the entire surface of the workpiece with an absorbent, in order to obtain a higher absorption of radiation, and thus a uniform, greater heating over the entire surface.

Figure 2:
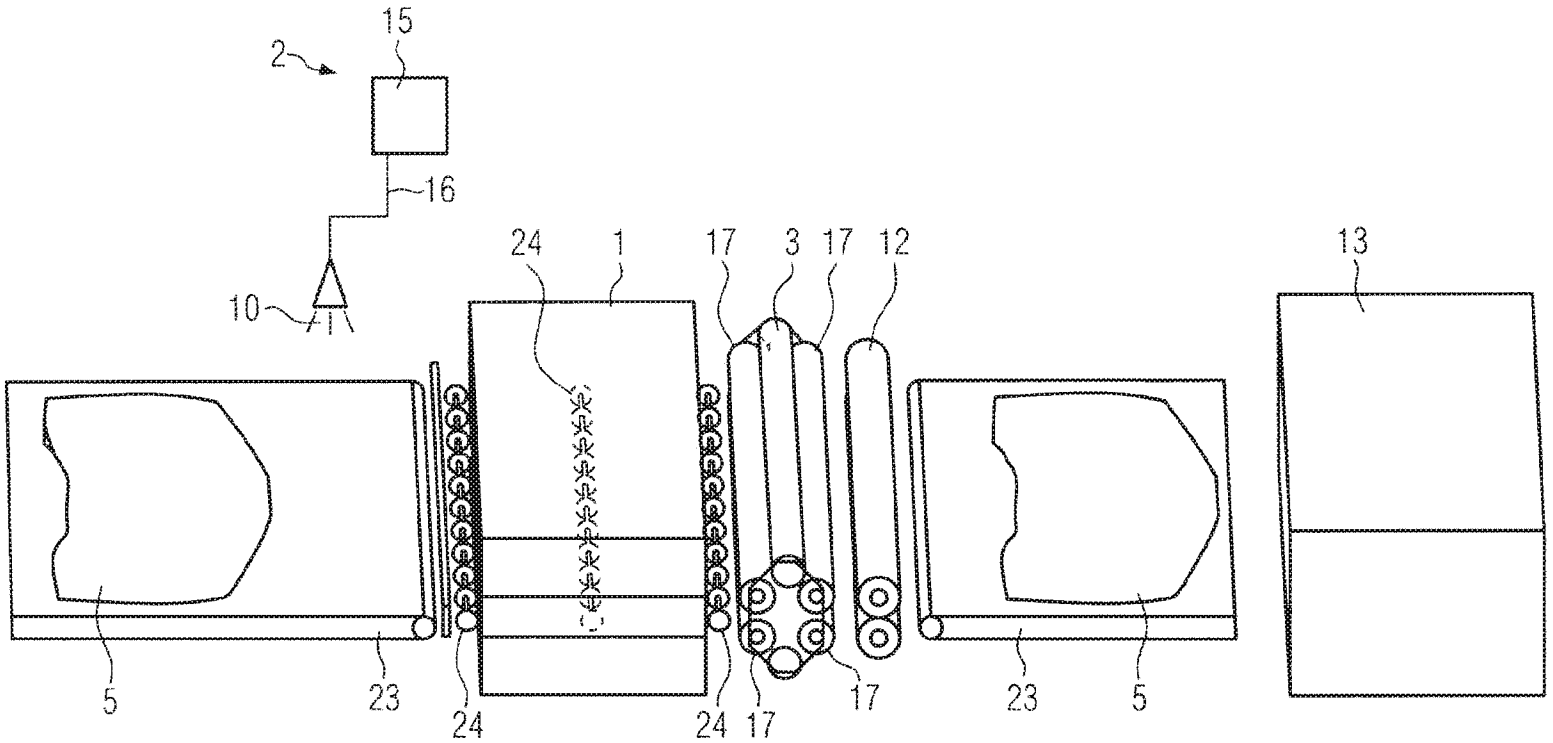
FIG. 2 shows a schematic illustration of a second exemplary embodiment of a production device according to the invention.

FIG. 2 shows an alternative embodiment of a production device according to the invention, in which the cleaning station 3 is located downstream of an oiling station 12, by means of which the workpieces are coated with a film of oil after the absorbent 10 has been removed, in order to prepare the workpieces for the subsequent shaping process. For this, after the workpieces 5 have been cleaned and oiled, they are not placed on a second stack, but instead are conveyed to a press 13 in which the subsequent shaping takes place.

The schematically illustrated coating station 2 has a nozzle 14, by means of which the absorbent 10 can be sprayed locally onto the workpiece 5. The absorbent 10 is stored in a reservoir 15, and conducted to the nozzle 14 by means of a hose. The cleaning station has two pairs of opposing stripping rollers 17, between which the workpiece 5 passes after it has been irradiated, such that the absorbent 10 is stripped off of the workpiece 5 through contact with the stripping rollers 17, and is thus removed therefrom.

There are numerous disk rollers 24 in front of, inside and behind the infrared oven 1, each of which is mounted on an axle, which improve conveyance of the workpiece from the conveyor belt 23 into the oven, inside the oven, and into the cleaning station 3.

Figure 3:
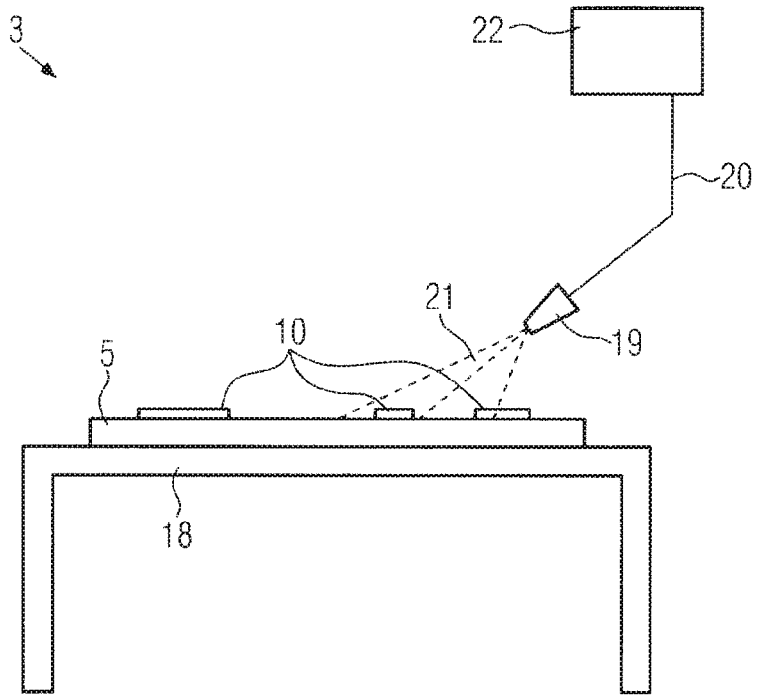
FIG. 3 shows a schematic illustration of an embodiment of a cleaning station with a cleaning nozzle.

FIG. 3 shows a schematic illustration of an exemplary embodiment of a cleaning station 3. After passing through the oven 1, the metal workpiece 5 rests on a subsurface 18. The surface of the workpiece 5 is coated locally with an absorbent 10. The cleaning station 3 has a cleaning nozzle 19, to which a cleaning agent 21 is conducted from a cleaning agent reservoir 22 by means of a cleaning hose 20.

The cleaning agent 21 can be sprayed under pressure onto the workpiece 5 through the cleaning nozzle 19, thus resulting in a jet spray cleaning of the surface of the workpiece 5.

The method according to the invention is primarily suited for metal substances, in which a change in the mechanical properties takes place as a result of heating the metal. This is the case in particular with aluminum alloys that can be hardened through precipitation, which are formed, for example, with copper and magnesium alloy elements. The metal substance can be, by way of example, one of the aluminum alloys EN AW-5882, EN AW-6016 and EN AW-7021, or some other aluminum alloy of a similar composition.

Depending on the subsequent treatment, e.g. bending or pressing, the regions of the workpiece requiring a specific increase in plasticity as a result of local heating are selected. The workpiece is then conveyed to a coating station, in which the absorbent is applied to those regions in which plasticity is to be increased in a targeted manner.

The workpiece that has been pre-treated in the coating station is then subjected to radiation, which is absorbed in part on the surfaces of the pre-treated workpiece. This radiation can be a heat radiation or infrared radiation, for example, wherein the irradiation station can be an oven known in the field, i.e. an infrared oven, as in the first exemplary embodiment. The temperatures reached at least in sections of the workpiece are advantageously approx. 250° C. to 500° C. The temperature in the oven typically fluctuates within a range of approx. 1000° C.

Through the increased degree of absorption of the absorbent, a larger portion of the radiation striking the surface is absorbed than in the untreated surface of the workpiece. As a result, the absorbent heats up locally more than the other surfaces of the workpiece, and reaches a higher temperature more quickly. Because the absorbent is in contact with the underlying surface of the workpiece, the quick heating of the absorbent leads to a likewise more quickly resulting temperature increase in the underlying surface section of the workpiece in contact with the absorbent. This results in the desired effect that the regions of the workpiece coated with absorbent reach a higher temperature with the same radiation output than those regions of the workpiece that are not coated.

Two-phase mixtures composed of a liquid carrier medium and a powdered absorbent are particularly suitable as absorbents. The carrier medium can primarily be a flowing or workable medium, such that the absorbent can be applied evenly in the coating station, such that it thoroughly covers all of the targeted regions of the workpiece. The absorbent should also exhibit the highest possible degree of absorption, and adhere well to the surface of the workpiece.

Graphite with a grain size of less than 10 μm is suitable for the absorbent, by way of example. Graphite has a high degree of absorption for visible light, heat and infrared radiation, due to its black surface, and due to the specified grain size, it can be applied to the workpiece in a thin and thorough coating, and adheres well to the aluminum surface. In alternative embodiments, other black powders or substances that have a high degree of absorption can also be used. These should be heat resistant, such that they change very little or not at all when applied to the workpiece and/or when irradiated, in particular regarding their aggregate state, and with hardly any chemical reaction.

By way of example, liquid hydrocarbons or alcohols are suitable as the carrier medium, which form a suspension with the absorbent, wherein the carrier medium can be applied in liquid form to the workpiece, thus distributing the powdered absorbent suspended therein on the surface. The carrier medium can be selected such that it quickly and thoroughly evaporates at room temperature into the atmosphere, such that only the absorbent remains on the surface of the workpiece after the evaporation thereof. As a result, the absorbent is unable to flow further on the surface of the workpiece, such that only the desired regions of the workpiece remain coated with the absorbent and are accordingly heated more than the other regions of the workpiece. The carrier medium should likewise be as heat resistant as the absorbent. During evaporation, it should be ensured that the carrier medium does not ignite when exposed to the atmosphere or a surrounding gas. Components of the carrier medium remaining on the workpiece during irradiation should remain chemically stable at the high temperatures in the oven.

After heating the workpiece in the irradiation station, the absorbent is removed form the workpiece in a cleaning station in the illustrated embodiments. As shown in FIG. 2, this can take place using stripping rollers that come in contact with the workpiece such that the absorbent is stripped from the surface of the workpiece. Two pairs of opposing stripping rollers 17 are shown in FIG. 2, wherein the workpiece passes between the two stripping rollers forming a pair, and comes in contact with both stripping rollers simultaneously.

The embodiment of a cleaning station shown in FIG. 3 is based on a different active principle. In this embodiment, a cleaning agent 21 composed of liquid or gaseous components, is sprayed at high pressure onto the surface of the workpiece 5. As a result, the absorbent is released from the surface of the workpiece 5 and removed.

In alternative embodiments, the principles for removing the absorbent, schematically shown in FIGS. 2 and 3, can also be combined or carried out successively in order to obtain a good cleaning result.

Figure 4:
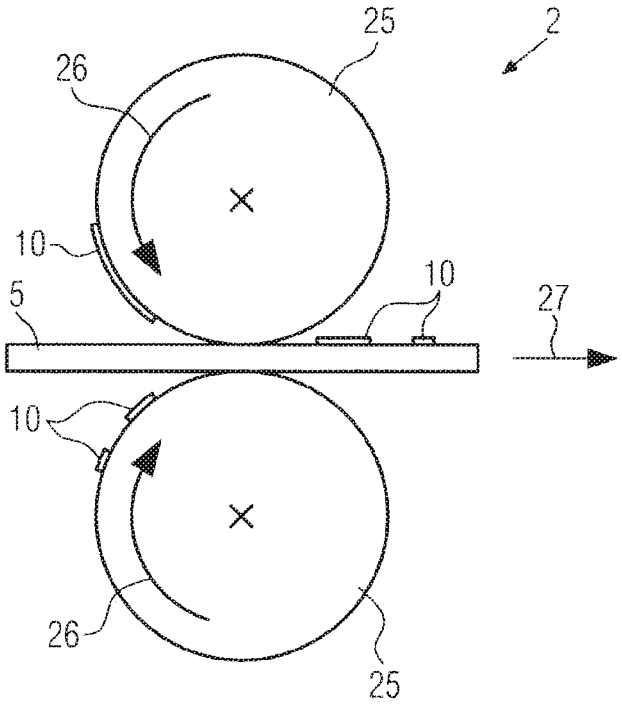
FIG. 4 shows a schematic illustration of an alternative embodiment of a coating station.

FIG. 4 shows an alternative embodiment of a coating station 2. The workpiece 5 moves in a direction of movement 27 between two applicator rollers 25, which have the absorbent on sections of their surfaces, and which roll in the rotational direction 26 over the workpiece 5. The workpiece 5 is a plate with two opposing parallel planar surfaces, each of which comes in contact with an applicator roller 25.

The absorbent 10 adheres to the workpiece 5 through the surface contact between the applicator rollers 25 and the workpiece 5, and is transferred from the applicator rollers 25 to the workpiece 5 thereby. The active principle of this arrangement is similar to the offset printing methods known from printing technology. Instead of two opposing applicator rollers 25, a single applicator roller with a rigid counter-resistance can be used, or only one of the applicator rollers may be provided with absorbent, such that absorbent is only applied to one side of the workpiece. Instead of a plate, this method can also be applied to workpieces of different shapes, which have more than two surfaces.

Figure 5:
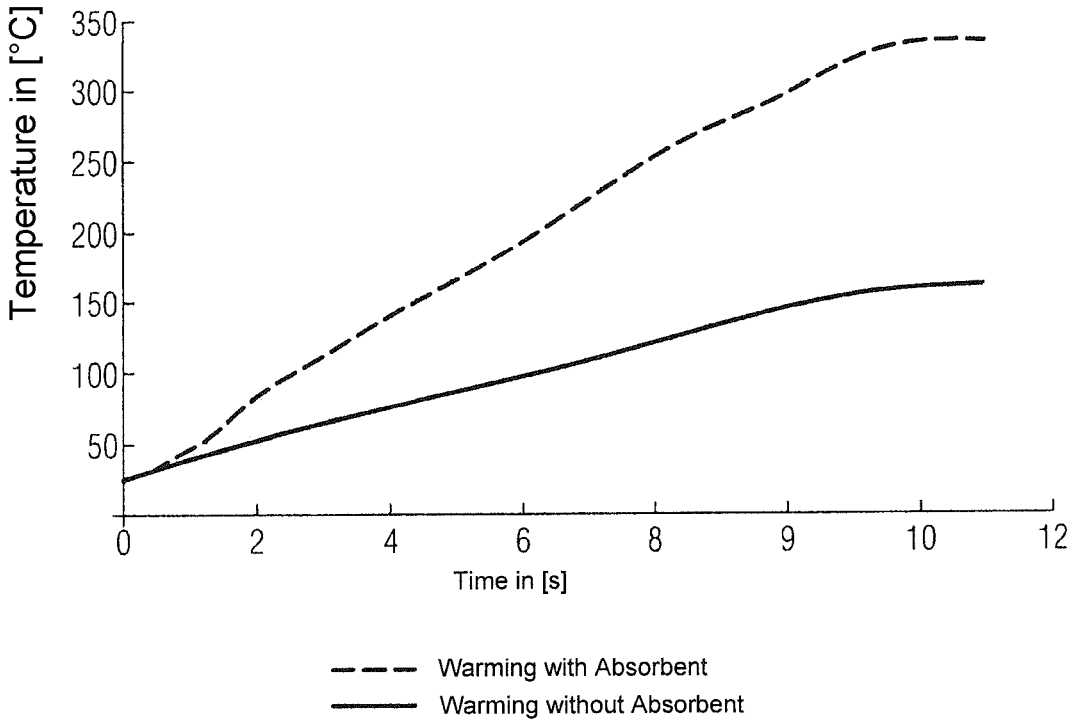
FIG. 5 shows a diagram, in which the course of the temperature increase over the period of irradiation is shown for surfaces of a metal workpiece to which an absorbent has been applied in comparison with surfaces of the same metal workpiece to which no absorbent has been applied.

FIG. 5 shows two graphs plotting the temperature curves in the surface of an aluminum plate in a radiation oven, wherein it can be clearly seen that those surface regions that are coated with an absorbent reach a higher temperature substantially more quickly than those surface regions that are not coated with an absorbent. Both surfaces are subjected to the same radiation output. It is clear from the diagram that with equal radiation periods of 12 seconds, the surfaces with absorbent reach an end temperature of 300° C., that is three times as high as those surfaces without absorbent, which only reach 100° C. Similarly, this shows that the end temperature of 100° C. is reached in the regions without absorbent in 6 seconds, while the regions with an absorbent reach this temperature in 2 seconds, thus reaching this temperature in one third of the time.

What is claimed is:

1. A method for at least locally increasing the plasticity of a metal workpiece, which contains an aluminum alloy, wherein the workpiece is irradiated in order to increase its temperature, an absorbent is applied to a first region of the workpiece prior to irradiation, the absorbent is not applied to a second region of the workpiece, the absorbent includes graphite and the degree of absorption of the absorbent for the radiation is greater than the degree of absorption of the workpiece for the radiation, wherein the absorbent adheres to where it is applied to the workpiece during irradiation of the workpiece even when the workpiece is shaken or moved, and further including shaping only the first region of the workpiece which includes the absorbent applied thereto after irradiation.

2. The method according to claim 1, wherein the absorbent is applied to at least two sides of the metal workpiece.

3. The method according to claim 1, wherein the absorbent contains grey and/or black components.

4. The method according to claim 1, wherein the absorbent at least partially evaporates after application to the workpiece and prior to irradiation.

5. The method according to claim 1, wherein the absorbent includes a carrier medium, the carrier medium includes at least one of a hydrocarbon and an alcohol, and wherein the absorbent is powdered.

6. The method according to claim 1, wherein the absorbent is sprayed onto the workpiece by a nozzle.

7. The method according to claim 1, wherein the absorbent is applied to the workpiece by at least one applicator roller, and the workpiece is guided between at least one pair of opposing stripping elements.

8. The method according to claim 1, wherein at least a portion of the absorbent is stripped from the workpiece by at least one stripping roller after irradiating the workpiece, and/or at least a portion of the absorbent is removed from the workpiece by applying a cleaning agent which contains liquid and/or gaseous components to the absorbent after irradiating the workpiece.

9. The method according to claim 8, wherein the cleaning agent is sprayed under pressure onto the workpiece, and the workpiece is spray-cleaned.

10. The method according to claim 1, wherein the aluminum alloy of the workpiece includes copper and magnesium.

11. The method according to claim 1, wherein the shaping includes bending or pressing regions of the workpiece where the absorbent was applied, the bending or pressing being conducted after the irradiation.

12. The method according to claim 1 including irradiating the workpiece in an infrared oven at a temperature of 250° C. to 500° C. after applying the absorbent to the workpiece.

13. The method according to claim 1, wherein the graphite has a grain size of less than 10 μm.

14. The method according to claim 13, wherein the aluminum alloy of the workpiece includes copper and magnesium, the method further includes irradiating the workpiece in an infrared oven at a temperature of 250° C. to 500° C. after applying the absorbent to the workpiece, and the shaping includes bending or pressing regions of the workpiece where the absorbent was applied, the bending or pressing being conducted after the irradiation.

* * * * *